US006299253B1

(12) United States Patent
Chen

(10) Patent No.: US 6,299,253 B1
(45) Date of Patent: Oct. 9, 2001

(54) TELESCOPIC POSITIONING MECHANISM FOR CHAIR BACKREST

(76) Inventor: Chao Ken Chen, No. 15-1, Fu-Kung Rd., Chung-Hua Hsien (TW)

( * ) Notice: Subject to any disclaimer, the term of this patent is extended or adjusted under 35 U.S.C. 154(b) by 0 days.

(21) Appl. No.: 09/641,293

(22) Filed: Aug. 18, 2000

(30) Foreign Application Priority Data

Aug. 19, 1999 (TW) ..... 88214100

(51) Int. Cl.[7] ..... B60N 2/02
(52) U.S. Cl. ..... 297/353
(58) Field of Search ..... 297/353, 463.1; 248/161, 157, 407, 408

(56) References Cited

U.S. PATENT DOCUMENTS 4,639,039 * 1/1987 Donovan .
5,649,741 * 7/1997 Beggs .
5,685,609 * 11/1997 Miotto .
5,951,107 * 9/1999 Tornero .
6,155,643 * 12/2000 Gorgi et al. .

* cited by examiner

*Primary Examiner*—Milton Nelson, Jr.
(74) *Attorney, Agent, or Firm*—Pro-Techtor International Services

(57) ABSTRACT

A telescopic positioning mechanism for chair backrest comprises a channel on backrest including a notched member, a top ramp, a bottom ramp, and two side grooves, a guide on the chair support including two side tongues slidably engaging with grooves and an anchored torsion spring, and a latch member biased by torsion spring to engage with one notch in a locked position. Pull backrest up in adjusting the height of channel with respect to guide. In turn, the locked latch member is pushed rightward to clear from the notch. Latch member is biased leftward to move into engagement with the next adjacent notch by virtue of torsion spring. In a highest position, latch member moves along bottom ramp to a free position. Then pushes down backrest to cause it to reach its lowest position such that latch member moves along top ramp to a free position. Backrest is capable of being locked by notched member in one of a plurality of vertical positions relative to the seat.

8 Claims, 7 Drawing Sheets

TELESCOPIC POSITIONING MECHANISM FOR CHAIR BACKREST

FIELD OF THE INVENTION

The present invention relates to telescopic positioning mechanisms and more particularly to a telescopic positioning mechanism for chair backrest so as to adjust the height of the backrest relative to chair seat.

BACKGROUND OF THE INVENTION

Office chairs are widely used throughout the world. In general, such chair is equipped with a padded backrest and even a pair of armrests for providing a degree of comfort to the seated person. Further, some backrests in such chairs are height adjustable as detailed below.

A conventional height adjustable backrest is disclosed in, for example, U.S. Pat. No. 4,639,039 entitled "Height Adjustable Mechanism For Chair Backrest". Such mechanism 12 comprises a guide 24 secured to support 18 and a channel 28 secured to backrest 22 and mounted for vertical sliding movement on guide 24. In operation, bias latch pin 36 of latch bar 32 along slot 38 for engaging latch pin 36 with one of notches 51 through 56 so as to lock backrest 22 in one of height positions H1 through H6.

But this is unsatisfactory for the purpose for which the invention is concerned for the following reasons:

1. The positioning of torsion spring 40 is not well maintained. As such, torsion spring 40 is prone to disengage from the predetermined position thus failing the mechanism 12.
2. The biasing of latch bar 32 is made possible totally by virtue of the spring force of legs 64, 66 of torsion spring 40. This may cause fatigue to torsion spring 40 after a short period of time of intensive use, resulting in a malfunction of torsion spring 40.
3. It is possible that latch bar 32 is over headed in operation when torsion spring 40 is malfunctioned.

In view of the foregoing, it is desirable to provide an improved telescopic positioning mechanism for chair backrest in order to overcome the above drawbacks of prior art.

SUMMARY OF THE INVENTION

It is an object of the present invention to provide a telescopic positioning mechanism mountable on a chair such that backrest of chair can be manually raised or lowered to one of a plurality of vertical positions relative to the chair seat in a simple reliable manner.

To achieve the above and other objects, the telescopic positioning mechanism of present invention comprises a guide rigidly secured to a support of a chair and a channel rigidly secured to a backrest wherein channel comprises a notched member consists of a plurality of notches in a side of slot, a top ramp in the top end of slot, a bottom ramp in the bottom end of slot, and two vertically extending grooves on opposite sides; guide comprises a center section, two side tongues for slidably engaging with the grooves, a plurality of horizontal and vertical flanges on the rear side, a plurality of horizontal grooves defined by the flanges, a recess adjacent the groove, a stud, and a torsion spring put on stud; latch member is biased by the torsion spring to engage with one notch in a locked position, the latch member comprises a ratchet bar, two posts engaged with the grooves, and a projection; a bottom ramp is sloped downwardly from the lowest notch; and a top ramp is sloped upwardly from the highest notch. In operation, pull backrest up in adjusting the height of channel with respect to guide. In turn, the locked latch member is pushed rightward to clear from the notch. Latch member is biased leftward to move into engagement with the next adjacent notch by virtue of torsion spring. In a highest position, ratchet bar passes over the lowest notch to cause the latch member to move along the bottom ramp to a free sliding position wherein projection is engaged with recess. Then pushes down backrest to cause it to reach its lowest position with the ratchet bar passing over the highest notch such that latch member moves along top ramp to a free sliding position wherein projection is out of engagement with recess. Latch member is again locked by notched member by virtue of torsion spring.

The above and other objects, features and advantages of the present invention will become apparent from the following detailed description taken with the accompanying drawings.

DETAILED DESCRIPTION OF THE PREFERRED EMBODIMENTS

Figure 1:
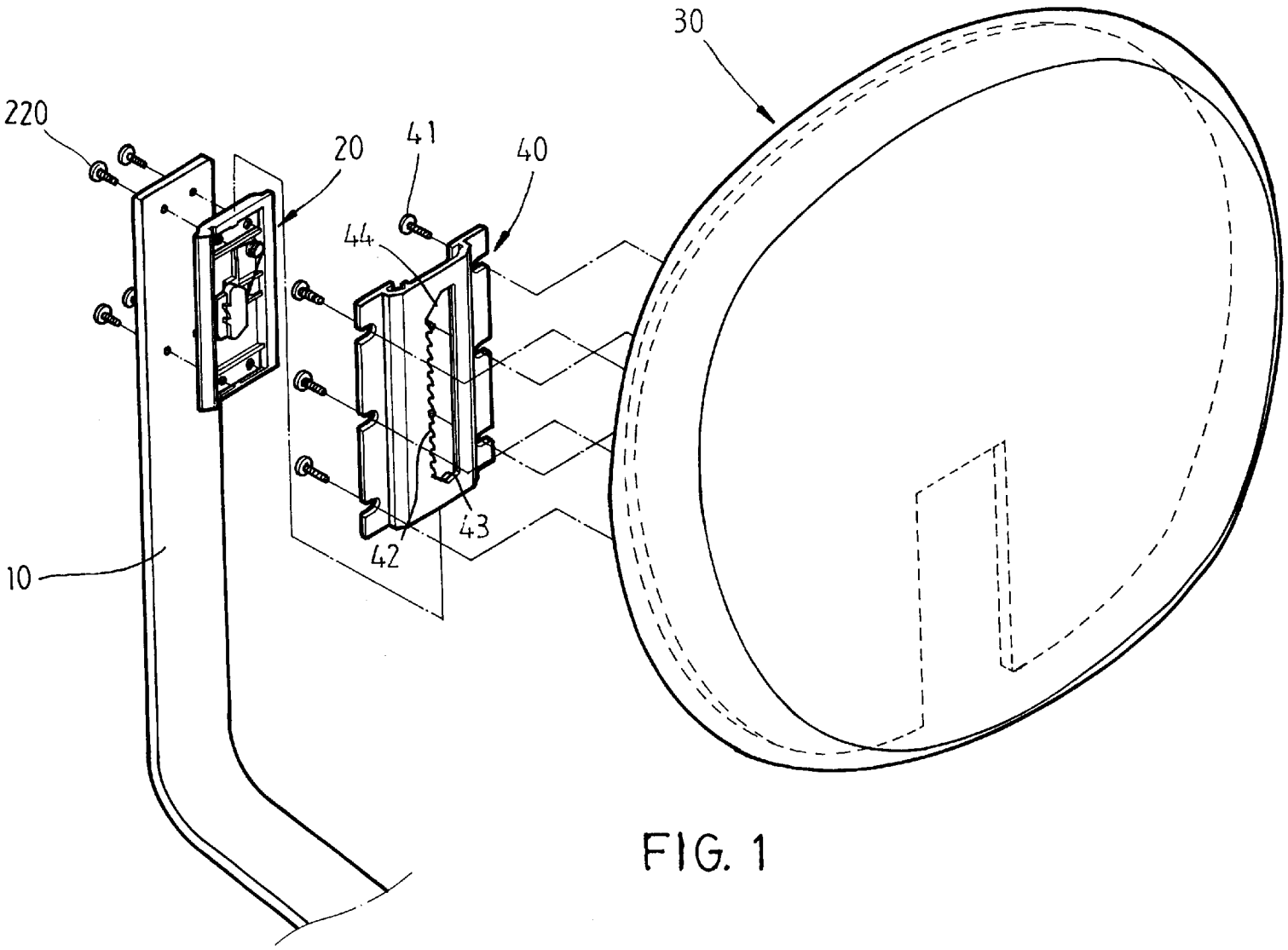
FIG. 1 is an exploded view of a backrest height adjustment mechanism according to the invention mounted on the support of chair.
Figures 2, 3:
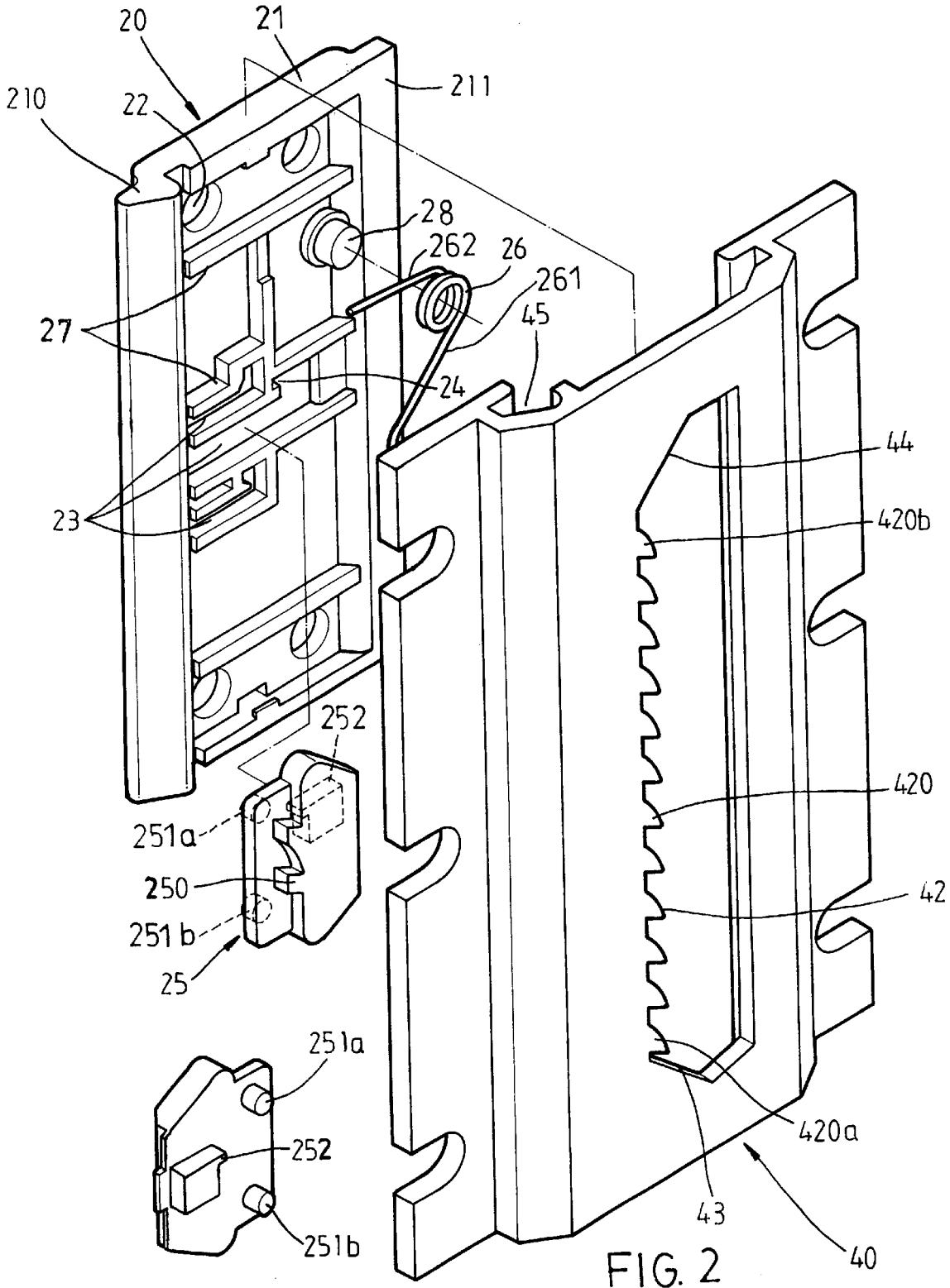
FIG. 2 is greatly enlarged exploded view of the FIG. 1 mechanism including a channel, a latch member, and a guide.
FIG. 3 a rear perspective view of latch member shown on FIG. 2.
Figure 4:
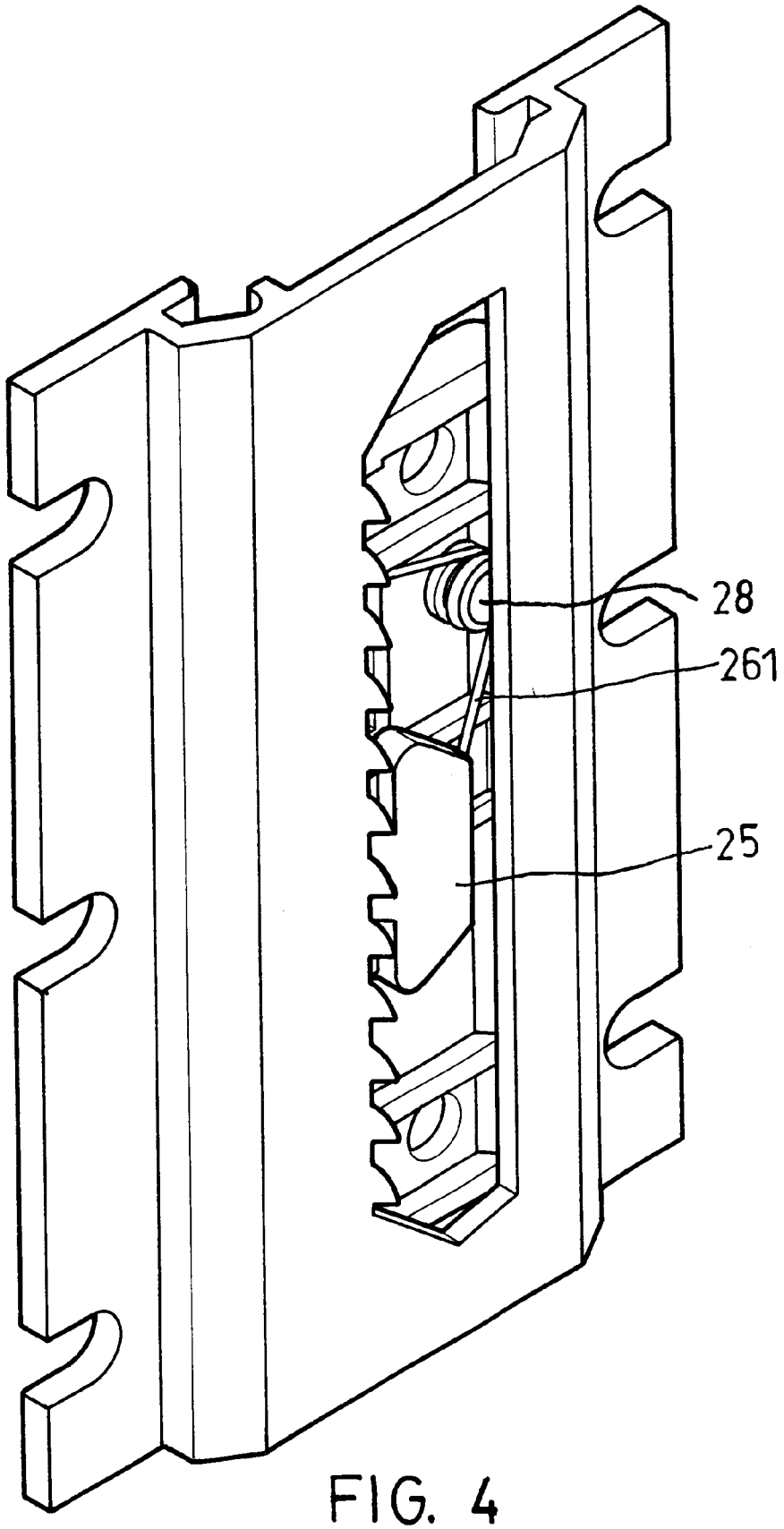
FIG. 4 is a perspective view of the assembled FIG. 2 mechanism.
Figure 5:
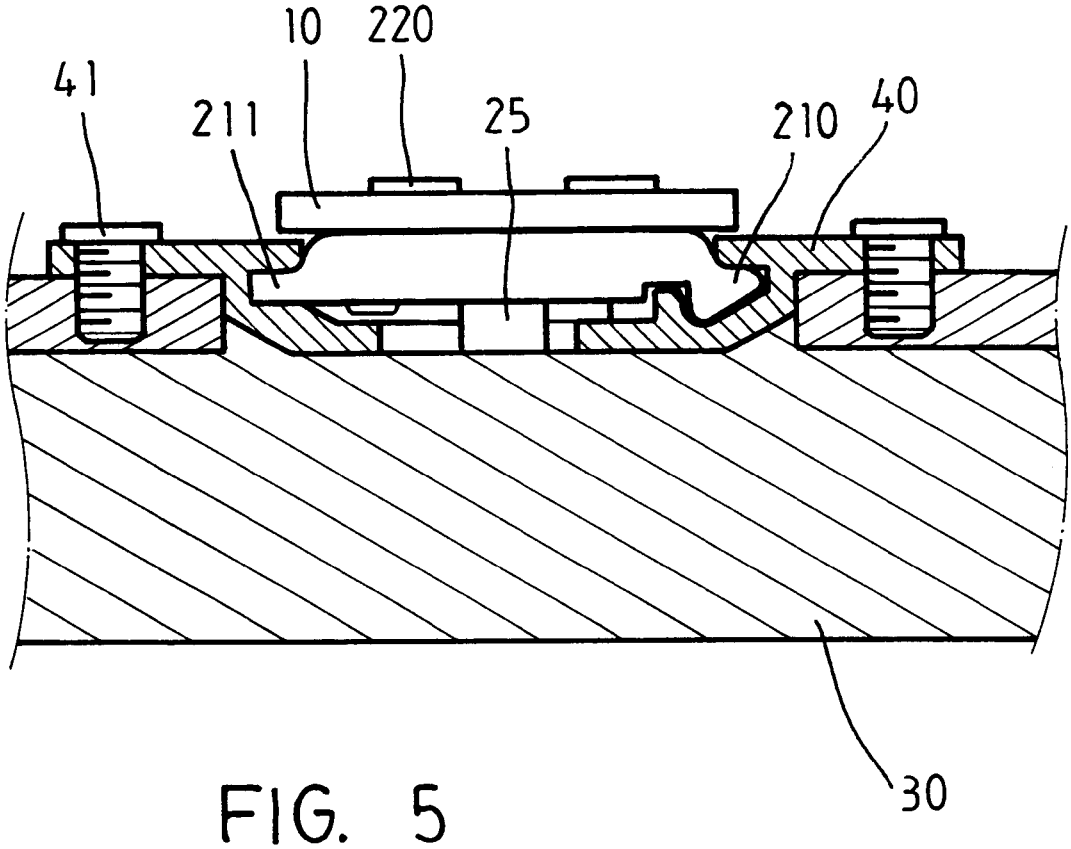
FIG. 5 is an enlarged cross-sectional view of the assembled FIG. 1 mechanism to show the features of the top portion thereof.

Referring to FIG. 1, there is shown a telescopic positioning mechanism for chair backrest constructed in accordance with the invention comprising a guide 20 threadedly secured to seat support 10 (as detailed later) and a channel 40 threadedly secured to backrest 30 by a plurality of bolt 41 and mounted for vertical sliding movement on guide 20.

Referring to FIGS. 2 to 5, channel 40 comprises a notched member 42 in a side of slot, a top ramp 44 in the top end of slot, a bottom ramp 43 in the bottom end of slot, and two vertically extending grooves 45 on opposite sides. Notched member 42 consists of a plurality of notches 420 such as highest notch 420*b* and lowest notch 420*a*.

Guide 20 is a plate member comprising a center section 21, two side tongues 210, 211 for slidably engaging with the grooves 45 (see FIG. 5), a plurality of threaded holes 22 with bolts 220 (or rivets) passed through for securing guide 20 to support 10 (FIG. 1), a plurality of horizontal and vertical flanges 27 on the rear side, a plurality of horizontal grooves 23 defined by the flanges 27, a recess 24 adjacent one of grooves 23, a stud 28, and a torsion spring 26 having legs 261, 262, torsion spring 26 being put on stud 28.

Latch member 25 comprises a ratchet bar 250, two posts 251*a*, 251*b* engaged with grooves 23, and a projection 252 engaged with recess 24 when latch member 25 in a free sliding position as detailed below.

Bottom ramp (or inclined surface) 43 is sloped downwardly from the lowest notch 420*a*, while top ramp (or inclined surface) 44 is sloped upwardly from the highest notch 420*b*.

Referring to FIGS. 6A to 6E, the operation of the mechanism will now be described.

Figure 6B:
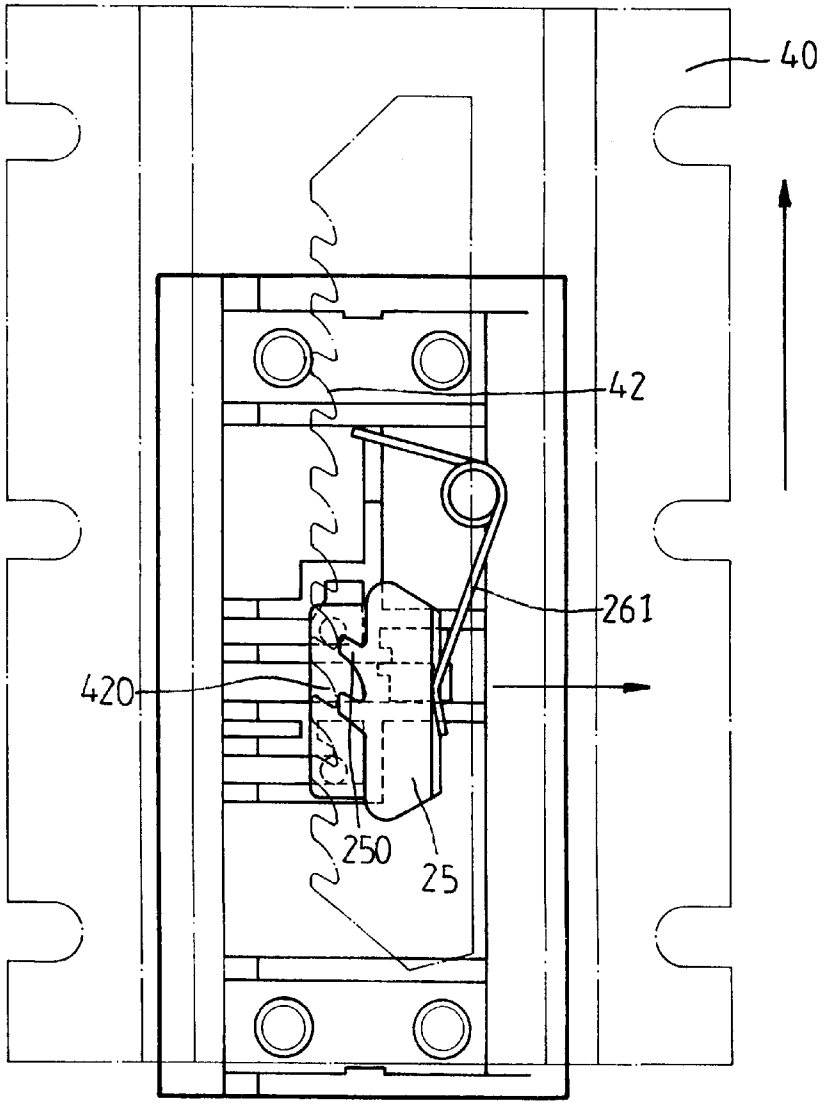
FIGS. 6A to 6E are plan views for showing the operation of the mechanism of the invention.
Figure 6A:
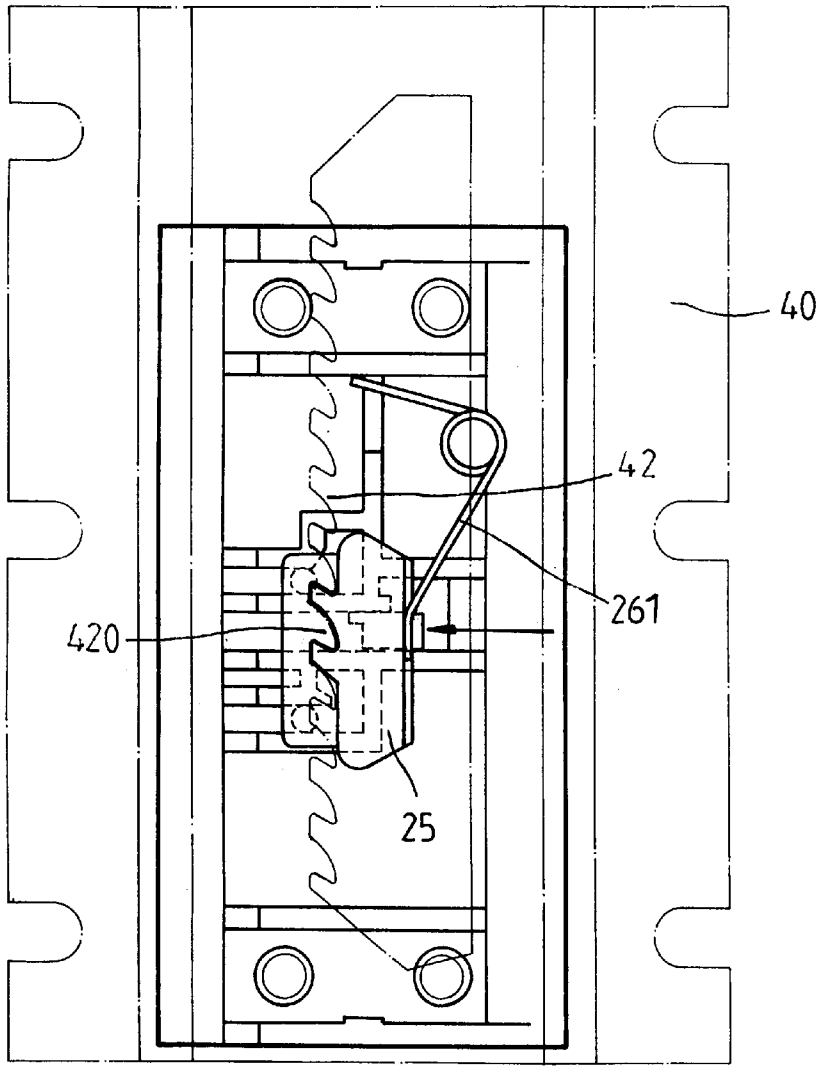

As shown in FIG. 6A, latch member 25 is biased by torsion spring 26 to engage with one notch 420 in a locked position of channel 40 (and backrest 30) relative to guide 20 (and seat support 10).

As shown in FIG. 6B, operator may pull backrest 30 together with channel 40 up in adjusting the height of channel 40 with respect to guide 20. In turn, a lateral force is created to push the locked latch member 25 rightward to clear from the notch 420. Finally, latch member 25 is biased leftward to move into engagement with the next adjacent notch 420 by virtue of torsion spring 26. That is, channel 40 is locked again.

Figure 6D:
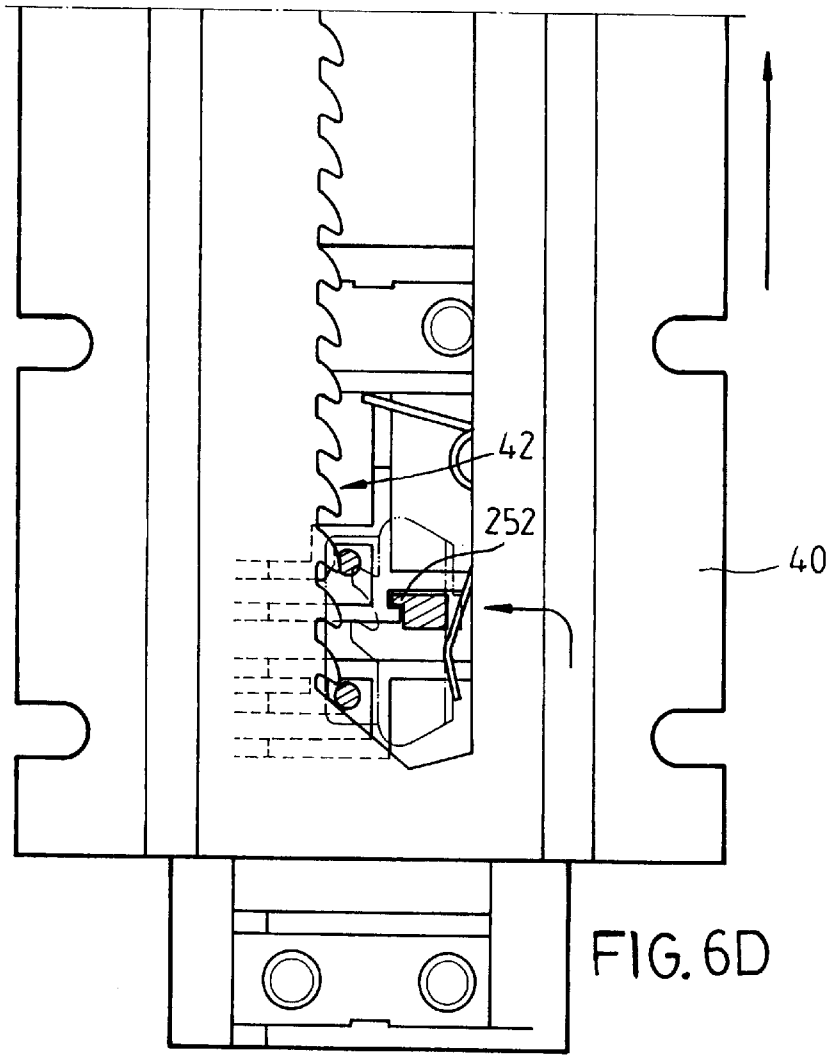
Figure 6C:
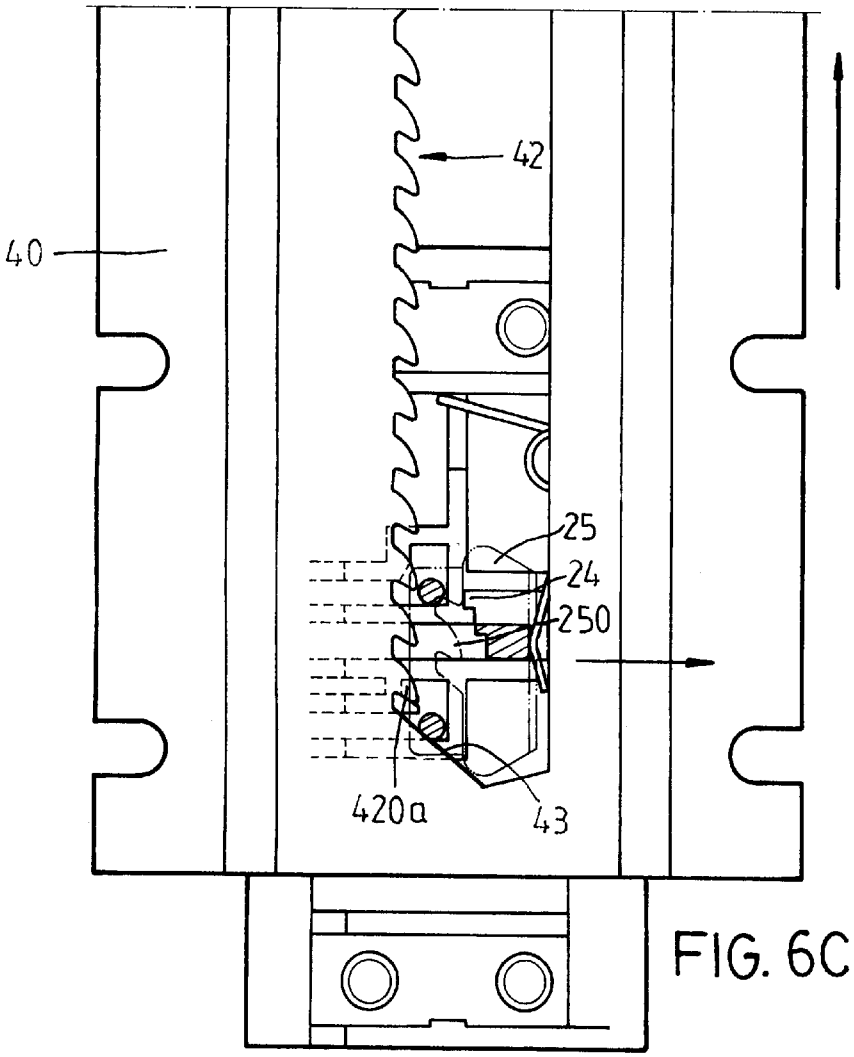

In FIG. 6C, channel 40 has reached to its highest position. That is, ratchet bar 250 has passed over the lowest notch 420*a*. At the position, the bottom of latch member 25 moves along ramp 43 to a free sliding position wherein projection 252 is engaged with recess 24. That is, latch member 25 is not locked by notched member 42 as shown in FIG. 6D.

Figure 6E:
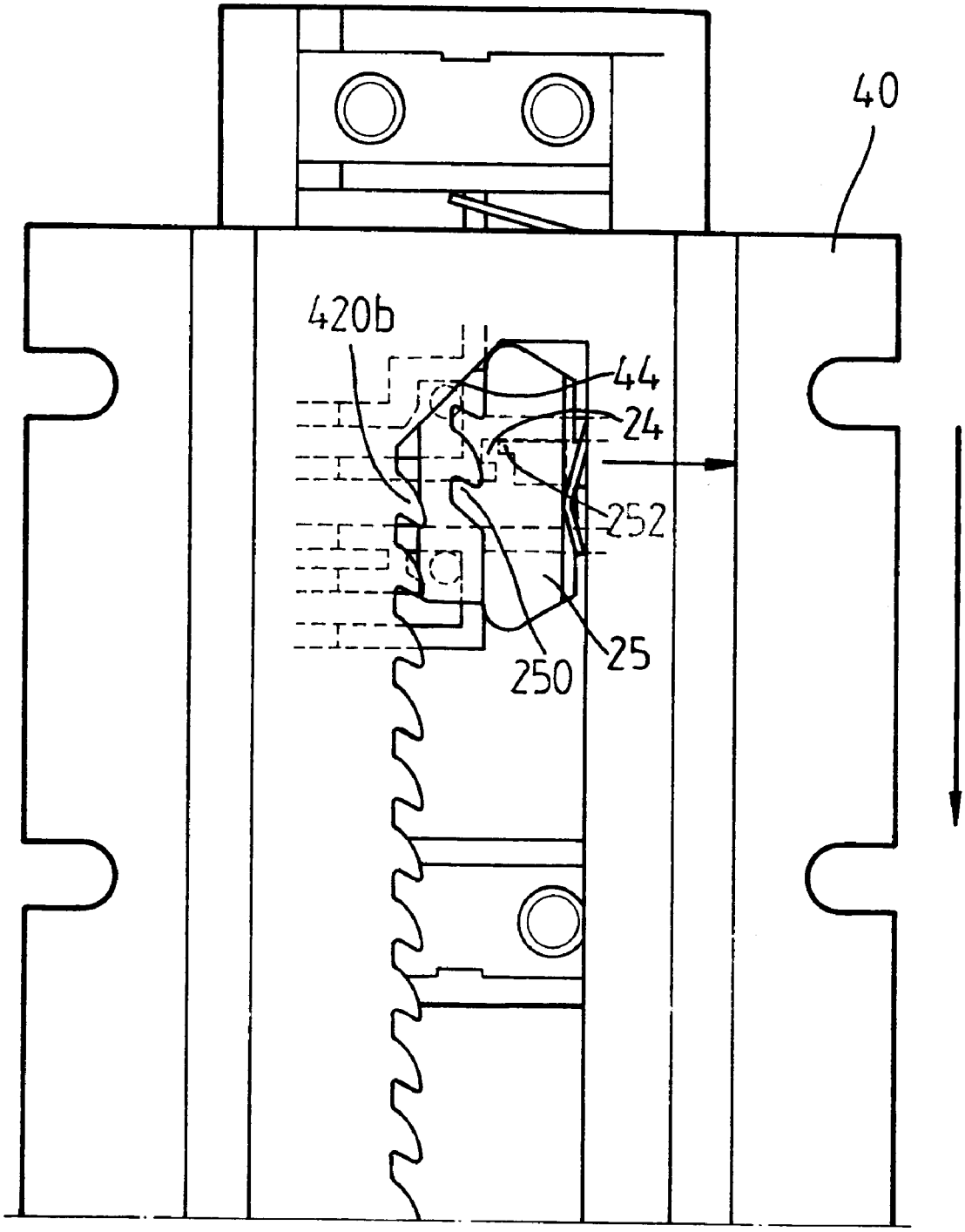

Similarly, operator may push down backrest 30 to cause it to reach its lowest position. That is, ratchet bar 250 has passed over the highest notch 420*b*. At the position, the top of latch member 25 moves along ramp 44 to a free sliding position wherein projection 252 is out of engagement with recess 24. Finally, latch member 25 is again locked by notched member 42 by virtue of torsion spring 26 as shown in FIG. 6E. Operator may repeat above procedure until a desired position is reached In brief, backrest of chair can be manually raised or lowered to one of a plurality of vertical positions relative to the chair seat in a simple reliable manner.

While the invention has been described by means of specific embodiments, numerous modifications and variations could be made thereto by those skilled in the art without departing from the scope and spirit of the invention set forth in the claims.

What is claimed is:

1. A telescopic positioning mechanism mounted on a chair for releasably locking a backrest of said chair in one of a plurality of vertical positions relative to a support affixed to a seat of said chair, comprising:

a channel on said backrest including a notched member consisting of a plurality of notches, a top ramp at a top end of said notched member, and a bottom ramp at a bottom end of said notched member;

a guide on said support including a center section, a plurality of horizontal and vertical flanges, a plurality of grooves defined by said flanges, a recess adjacent said groove, a stud, and a torsion spring on said stud; and a latch member biased by said torsion spring to engage with one of said notches in a locked position, said latch member including a ratchet bar and a projection, wherein said backrest is moved in a first direction to cause said locked latch member to disengage from said notch, said latch member is biased in a second direction to move into engagement with a next adjacent one of said notches by virtue of said torsion spring, in a highest position said ratchet bar passes over a lowest one of said notches to cause said latch member to move along said bottom ramp of said lowest one of said notches to a free position in which said projection is engaged with said recess, and in a lowest position said ratchet bar passes over a highest one of said notches such that said latch member moves along said top ramp of said highest one of said notches to a position in which said projection is out of engagement with said recess.

2. The positioning mechanism of claim 1, wherein said bottom ramp is sloped downward from said lowest one of said notches.

3. The positioning mechanism of claim 1, wherein said top ramp is sloped upward from said highest one of said notches.

4. The positioning mechanism of claim 1, wherein said channel further comprises a plurality of threaded holes, a plurality of first bolts passes through said threaded holes of said channel to secure said channel to said backrest.

5. The positioning mechanism of claim 1, wherein said guide further comprises a plurality of threaded holes, a plurality of second bolts passes through said threaded holes of said guide to secure said guide to said support.

6. The positioning mechanism of claim 1, wherein said channel further comprises two troughs, said guide is a plate member, and said guide further comprises two tongues to slidably engage said troughs.

7. The positioning mechanism of claim 1, wherein said grooves are two parallel grooves.

8. The positioning mechanism of claim 1, wherein said latch member further comprises two posts engaged with said grooves.

* * * * *